US006345817B1

(12) United States Patent
Kakegawa et al.

(10) Patent No.: US 6,345,817 B1
(45) Date of Patent: Feb. 12, 2002

(54) DOCUMENT SHEET SEPARATOR AND OPTICAL DOCUMENT READER

(75) Inventors: Hirotoshi Kakegawa; Norio Kanemitsu, both of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/531,890

(22) Filed: Mar. 21, 2000

(30) Foreign Application Priority Data

Aug. 17, 1999 (JP) ..... 11-230560

(51) Int. Cl.[7] ..... B65H 5/22

(52) U.S. Cl. ..... 271/4.1; 271/111; 271/243; 271/270

(58) Field of Search ..... 271/4.1, 21, 111, 271/243, 220, 237, 216, 149, 109

(56) References Cited

U.S. PATENT DOCUMENTS 4,463,943 A * 8/1984 Deconinck ..... 271/21
4,690,392 A * 9/1987 Coons, Jr. ..... 271/2 X
5,848,784 A * 12/1998 Tranquilla ..... 271/10.03 X

FOREIGN PATENT DOCUMENTS

| | | | |
|---|---|---|---|
| JP | 361037634 A * | 2/1986 | ..... 271/21 |
| JP | 5-116810 | 5/1993 | |
| JP | 5-213487 | 8/1993 | |
| JP | 8-217274 | 8/1996 | |

* cited by examiner

*Primary Examiner*—Christopher P. Ellis
*Assistant Examiner*—Kenneth W Bower
(74) *Attorney, Agent, or Firm*—Armstrong, Westerman, Hattori, McLeland & Naughton, LLP

(57) ABSTRACT

A sheet separator to separate sheets of documents supplied as a stack into a single sheet. The sheet separator has a first separating mechanism and a second separating mechanism, each of which has a separating roller. The second separating mechanism is provided at a position downstream from the first separating mechanism. The peripheral velocity of the second separating roller may be set lower than a peripheral velocity of the first separating roller.

7 Claims, 9 Drawing Sheets

DOCUMENT SHEET SEPARATOR AND OPTICAL DOCUMENT READER

BACKGROUND OF THE INVENTION

1. Field of the Invention

The present invention relates generally to a sheet separator, and more particularly, to a document sheet separator adapted for use in an optical document reader.

2. Description of the Related Art

Generally, an optical document reader is an apparatus in which documents are sent or fed one sheet at a time from the top of a stack of document sheets set in the hopper of the optical document reader to an optical document reader unit that optically reads information printed on the document. Typically, such optical document readers include a document separator for separating sheets of documents into single sheets whenever two sheets are fed from the hopper at the same time, that is, whenever a double-feed occurs. Obviously, such a double-feed is undesirable and should be avoided wherever possible.

At present the range of types of materials from which documents are made is very large. In some cases, these materials from which documents are made are such that single sheets of such documents tend to stick together, making a double-feed more likely to occur. As a result, a sheet separator with an improved ability to separate such double-fed sheets of documents into single sheets is needed.

FIGS. 1A and 1B show an example of the prior art, that is, a conventional sheet separator. As shown in FIGS. 1A and 1B, the conventional sheet separator 10A consists of one separating roller 11, one torque roller 12, a pulse motor 13 that rotates the separating roller 11 and a separation force application mechanism 14 that imparts a separation force F to the torque roller 12, with the torque roller 12 being pressed against the separating roller 11. The torque roller 12 is coupled to a torque limiter not shown in the diagram so that the torque roller 12 remains stopped even if a certain amount of torque is applied and begins to rotate only when a predetermined amount of torque is applied. The separation force application mechanism 14 can be used to adjust the separation force F.

The above-described conventional sheet separator 10 typically remains inactive unless a double-feed occurs, that is, when the first document sheet 21-1 is fed onward by a pick-up roller 22 and a second document sheet 21-2 sticks to the back of a first document sheet 21-1 and is dragged together with the first document sheet 21-1, the first sheet 21-1 being the sheet positioned at the top of a stack 21 of multiple document sheets set in a hopper 20.

In the event of a double-feed like that described above, a forward longitudinal edge of the second sheet 21-2, which is on the bottom, is braked by the stopped torque roller 12 and the forward advance of the second sheet 21-2 is retarded thereby. At the same time, the first sheet 21-1, which is on the top and against which a feed force is exerted by the separating roller 11, slides over and separates from the second sheet 21-2 so that only the first sheet 21-1 is fed onward to the feed roller 23 by the separating roller 11. After the first sheet 21-1 is fed onward the second sheet, which had been braked by the torque roller 12 and any forward progress retarded thereby, is fed onward by the separating roller 11, with the torque roller 12 being rotated by the force of frictional contact with the second sheet 21-2.

It should be noted that, for clarity of illustration only, in FIG. 1B the second sheet 21-2 on the bottom is shown slightly smaller than the first sheet 21-1 on the top. A similar approach is taken with respect to FIGS. 7B, 8C and 8E.

However, a problem arises with the conventional sheet separator 10 like that described above insofar as the conventional sheet separator 10 is not fully capable of separating double-fed sheets. As a result, when the coefficient of friction between sheets is large, that is, when it is hard to separate the sheets set in the hopper 20, double-fed sheets are not separated but might pass through the document sheet separator 10 in that double-fed state.

Typically, the coefficient of friction between two documents stuck together differs depending on the type of documents in question, so the separation force application mechanism 14 described above is used to adjust the separation force F downward, that is, to reduce the separation force F in order to make it easier to separate the sheets. However, even with this adjustment of the separation force F depending on the type of paper used to make the document sheets it sometimes happens that document sheets are double-fed through the sheet separator 10.

SUMMARY OF THE INVENTION

Accordingly, it is an object of the present invention to provide an improved and useful document sheet separator in which the above-described disadvantage is eliminated.

The above-described object of the present invention is achieved by a sheet separator that separates sheets of documents supplied as a stack into single sheets, the sheet separator comprising:

a first separating mechanism having a first separating roller; and a second separating mechanism having second separating rollers, the second separating mechanism provided at a position downstream from a position of the first separating mechanism.

According to the invention described above, the second separating mechanism separates those sheets that are fed onward without being separated by the first separating mechanism.

Additionally, the above-described object of the present invention is also achieved by the sheet separator as described above, wherein a peripheral velocity of the second separating rollers is set lower than a peripheral velocity of the first separating roller.

According to the invention described above, setting the peripheral speed of the second separating rollers slower than the peripheral speed of the first separating roller causes a compressive force to act on the top sheet of two sheets double-fed onward without being separated by the first separating mechanism, causing such a top sheet to form an upward bulge.

Additionally, the above-described object of the present invention is also achieved by the sheet separator as described above, wherein the first separating roller is positioned so as to act upon a central portion in a lateral direction of a sheet transported thereto and the second separating rollers are positioned so as to act upon edge surface portions in the lateral direction of the sheet transported thereto.

According to the invention described above, positioning the second separating rollers so as to act upon edge portions of the sheet transported thereto causes the separation force to act on locations near the corners of the top sheet of two double-fed sheets, at which locations the top sheet is more easily separated from the bottom sheet.

Additionally, the above-described object of the present invention is also achieved by the sheet separator as described above, wherein:

a peripheral velocity of the second separating roller is set lower than a peripheral velocity of the first separating roller;

the first separating roller is positioned so as to act upon a central portion in a lateral direction of a sheet transported thereto; and the second separating rollers are positioned so as to act upon edge surface portions in the lateral direction of the sheet transported thereto.

According to the invention described above, setting the peripheral speed of the second separating rollers slower than the peripheral speed of the first separating roller causes a compressive force to act on a portion of the top sheet of two sheets double-fed onward without being separated by the first separating mechanism that lies between the first separating roller and the second separating rollers, causing such a top sheet to form an upward bulge.

Additionally, as described above, positioning the second separating rollers so as to act upon edge portions of the sheet transported thereto causes the separation force to act on locations near the corners of the top sheet of two double-fed sheets, at which locations the top sheet is more easily separated from the bottom sheet.

Additionally, positioning the first separating roller so as to act upon a central portion of a sheet transported thereto causes the separation force applied by the second separating rollers to become a twisting force with respect to the location at which the first separating roller exerts a separation force.

Additionally, the above-described object of the present invention is also achieved by the sheet separator as described above, wherein the second separating rollers are supported so that positions of the second separating rollers in a lateral direction of a sheet transported thereto can be changed.

According to the invention described above, the document sheet separator according to the present invention can accommodate a plurality of different sizes of paper.

Additionally, the above-described object of the present invention is also achieved by the sheet separator as described above, wherein a distance between the first separating mechanism and the second separating mechanism is shorter than a longitudinal length of the sheet.

Additionally, the above-described object of the present invention is also achieved by an optical document reader comprising:

a hopper, to which a plurality of sheets can be set;

a sheet separator that separates sheets of documents supplied as a stack into single sheets;

a feed roller that transports documents;

an optical document reading unit that optically reads data inscribed on the documents; and a stacker that stacks and outputs documents from which data has been optically read by the optical document reading unit, the sheet separator comprising:

a first separating mechanism having a first separating roller; and a second separating mechanism having second separating rollers, the second separating mechanism provided at a position downstream from a position of the first separating mechanism.

According to the invention described above a double-feed is less likely to occur and, accordingly, a more reliable optical document reader can be attained.

Other objects, features and advantages of the present invention will become more apparent from the following detailed description when read in conjunction with the accompanying drawings.

DESCRIPTION OF THE PREFERRED EMBODIMENTS

For clarity of explanation, a description will first be given of an optical document reader 30 incorporating a sheet separator according to an embodiment of the present invention, with reference to FIG. 9.

Figure 9:
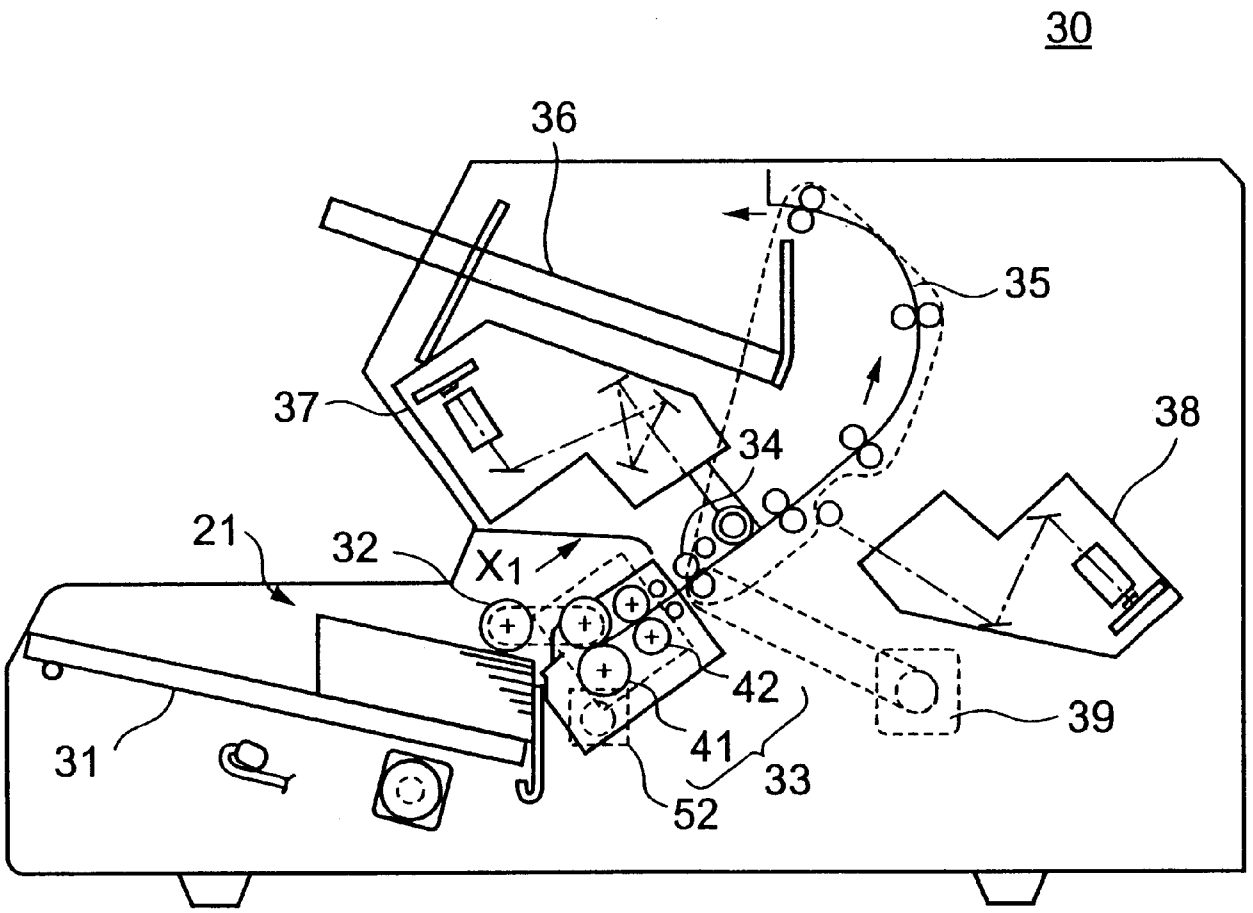
FIG. 9 is a schematic diagram of an optical document reader adapting the sheet separator shown in FIG. 2.

Generally, as shown in FIG. 9, the optical document reader 30 comprises a hopper 31, a pick-up roller 32, a sheet separator 33, a feed roller 34, a transport route 35, a stacker 36, an optical document reader unit 37 that reads a front surface of a document sheet and an optical document reader unit 38 that reads a back surface of a document sheet.

The optical document reader 30 is controlled by a host computer not shown in the diagram, and operates in the following manner.

Figure 6A:
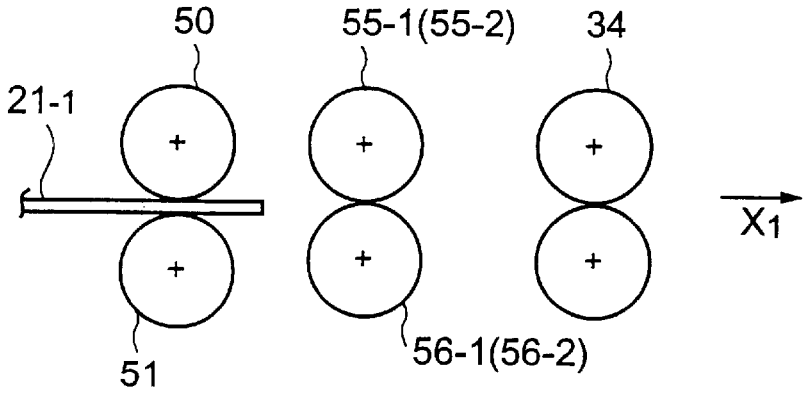
FIGS. 6A, 6B and 6C are diagrams showing the operation of the sheet separator when documents are supplied to it one sheet at a time.
Figure 6B:
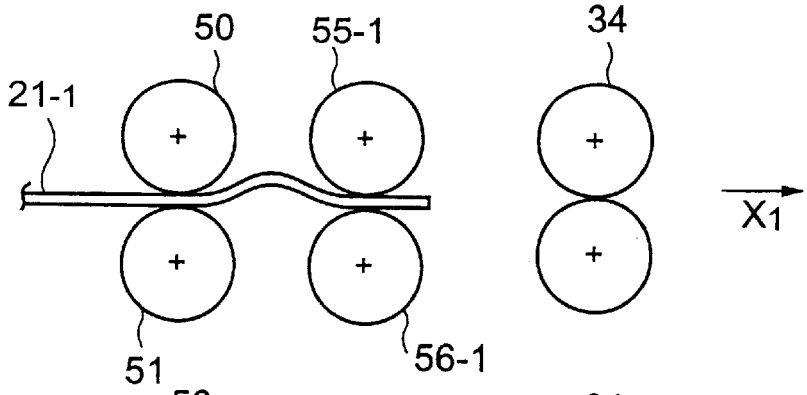
Figure 6C:
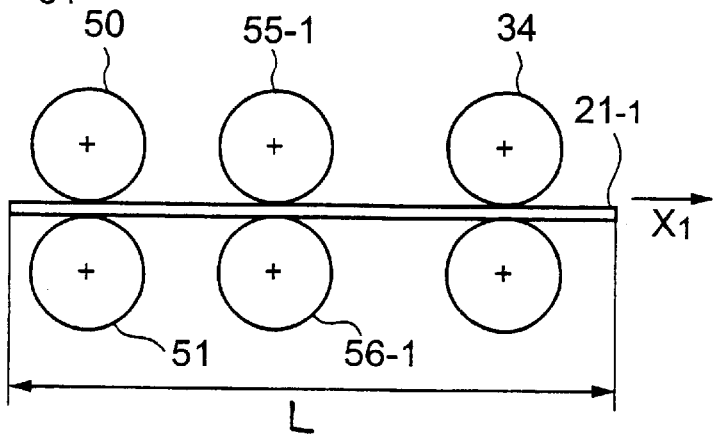
Figure 7A:
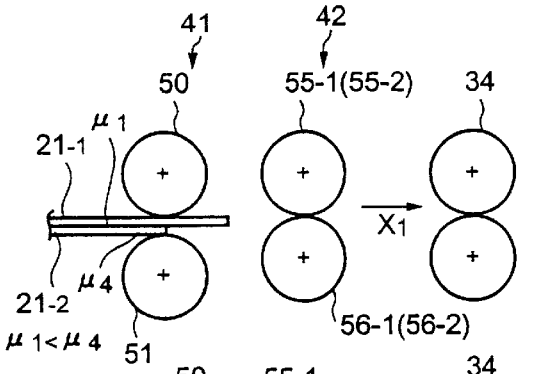
FIGS. 7A, 7B, 7C, 7D and 7E are diagrams showing the operation of the sheet separator when documents are double-fed.
Figure 7B:
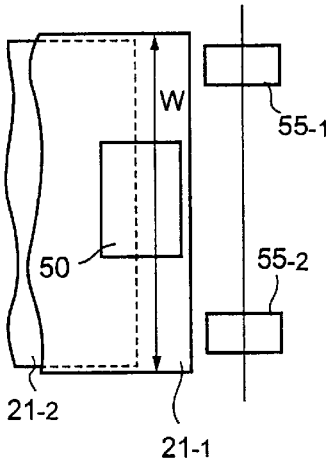

Multiple document sheets 21 set or stacked in the hopper 20 are taken one sheet at a time from the top of the stack, picked up from the hopper and sent in a direction indicated in the diagram as arrow X1 by the pick-up roller 32, transported or fed by the feed roller 34 driven by a motor 39, the information printed on the front surface of the document is read by the optical document reader unit 37 and the information printed on the back surface of the document is read by the optical document reader unit 38. Thereafter the document is ejected to the stacker 36 via the transport route 35. As shown in FIGS. 6C and 7B, respectively, the document sheet 21 has a length L and a width W.

A description will now be given of the sheet separator 33 according to a first embodiment of the present invention, with reference to FIGS. 2 and 3.

Figure 1A:
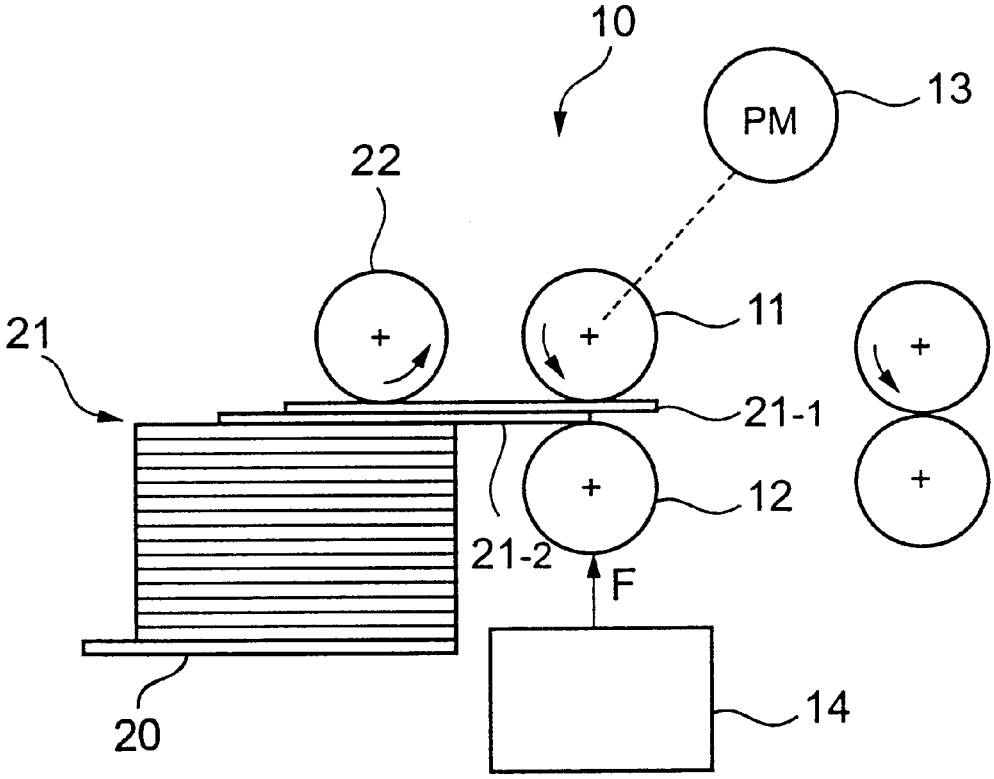
FIG.1A PRIOR ART
FIGS. 1A and 1B show a conventional sheet separator.
Figure 1B:
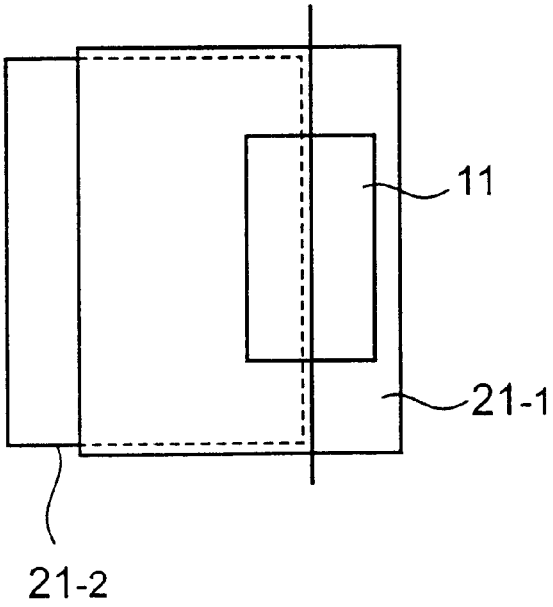
FIG.1B PRIOR ART
Figure 2:
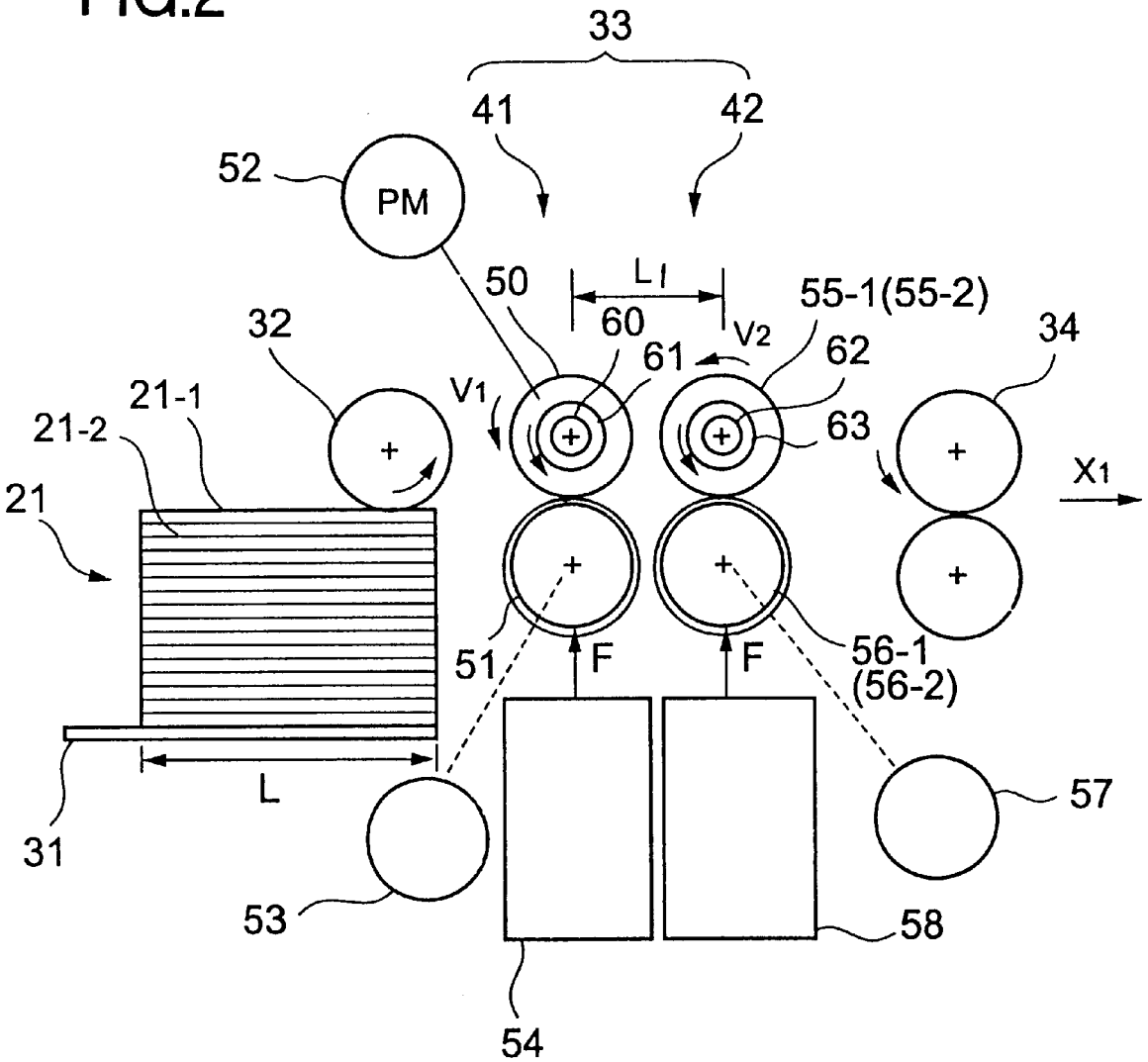
FIG. 2 is a side view of a sheet separator according to an embodiment of the present invention.

FIG. 2 is a side view of a sheet separator according to an embodiment of the present invention. FIG. 3 is a plan view of the sheet separator shown in FIG. 2. As shown in FIGS. 2 and 3, the sheet separator 33 is provided between the pick-up roller 32 and the feed roller 34. Additionally, the sheet separator 33 has a first separating mechanism 41 and a second separating mechanism 42.

The first separating mechanism 41 is positioned near the pick-up roller 32. The second separating mechanism 42 is positioned downstream from the first separating mechanism 41 in terms of the direction of transport of the document sheet 21, that is, in the direction of arrow X1, at a distance L1 from the first separating mechanism 41. The distance L1 is substantially shorter than the length L of the document sheet 21.

Figure 3:
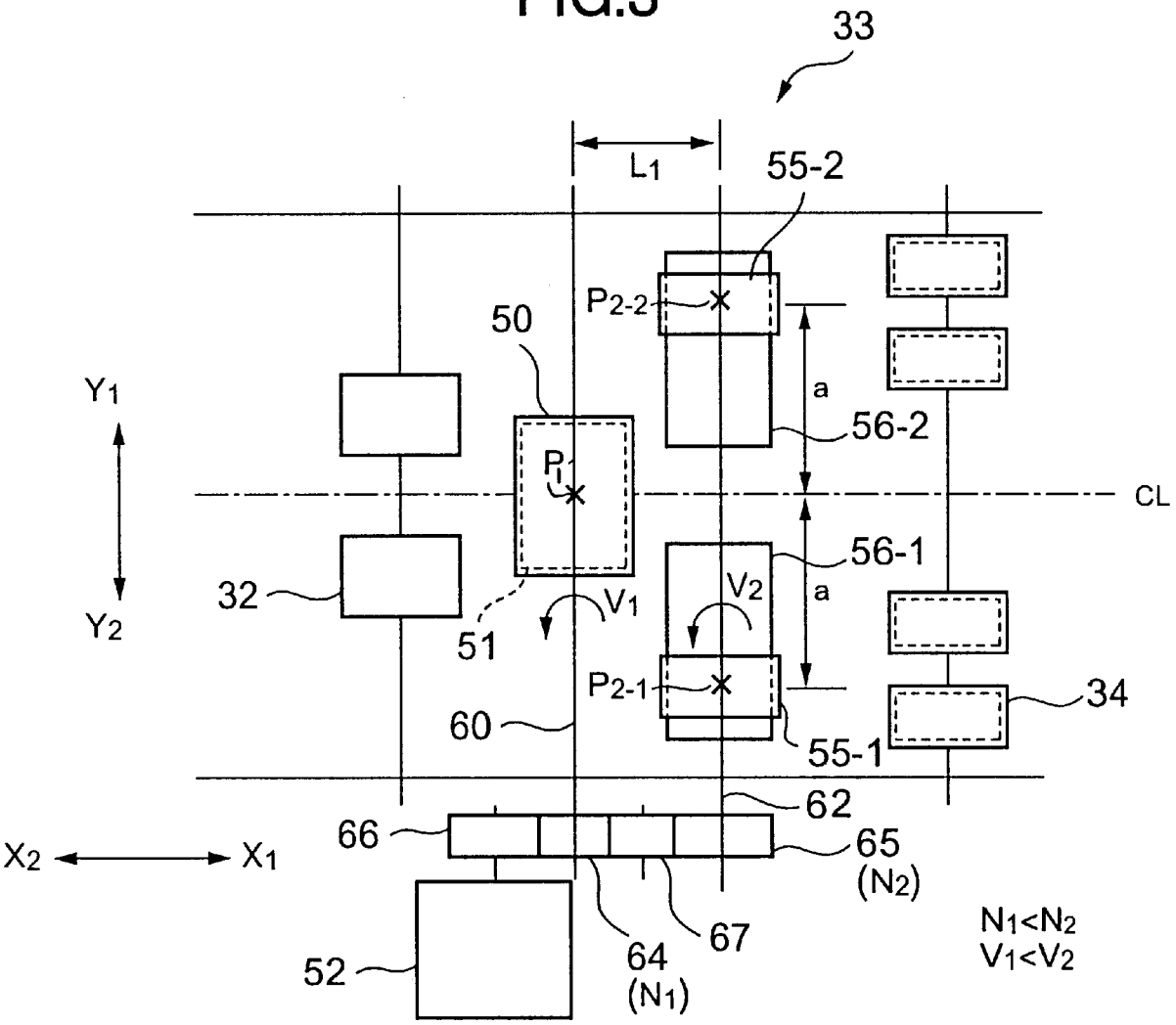
FIG. 3 is a plan view of the sheet separator shown in FIG. 2.

For clarity of explanation, it should be noted that a direction indicated as X1–X2 in FIG. 3 is the longer, longitudinal direction of the sheet separator 33 and, at the same time, is both the direction of transport of the document sheet 21 and the lengthwise direction of the document sheet 21. A direction indicated as Y1–Y2 represents a lateral width direction of the sheet separator 33 as well as a lateral width of the document sheet 21. CL represents a hypothetical centerline extending along a center of the sheet separator 33 in the longitudinal X1–X2 direction.

The first separating mechanism 41 comprises a first separating roller 50, a first torque roller 51, a pulse motor 52 that rotates the first separating roller 50, a first torque limiter 53 coupled to the first torque roller 51 that imparts a predetermined braking force to the first torque roller 51, and a first separation force application mechanism 54 that applies to the first torque roller 51 a separation force F that presses the first torque roller 51 against the first separating roller 50.

The second separating mechanism 42 comprises two second separating rollers 55-1 and 55-2, two second torque rollers 56-1 and 56-2, a second torque limiter 57 that imparts a predetermined braking force to the two second torque rollers 56-1 and 56-2, and a second separation force application mechanism 58 that applies to the second torque rollers 56-1, 56-2 a separation force F that presses the second torque rollers 56-1, 56-2 against the second separating rollers 55-1, 55-2. The second separating rollers 55-1, 55-2 are rotated by the pulse motor 52 described above via a gear.

As shown in FIG. 3, the first separating roller 50 of the first separating mechanism 41 is positioned at a position P1 on the centerline CL described above, and acts upon a central portion of the sheet in the lateral direction thereof during separation. The two second separating rollers 55-1, 55-2 of the second separating mechanism 42 are positioned equidistant from and to either side of the centerline CL in the lateral Y1–Y2 direction at a distance a from the centerline CL, at positions P2-1 and P2-2. Additionally, the two second separating rollers 55-1, 55-2 are also offset in the lateral Y1–Y2 direction with respect to the position of the first separating roller 50, at positions near the respective Y1 and Y2 lateral edges of the document sheet 21.

The first separating roller 50 is supported by a rotation shaft 60 via a one-way clutch 61 that transmits the counterclockwise rotation of the rotation shaft 60 to the first separating roller 50. Similarly, the second separating rollers 55-1, 55-2 are jointly supported by a rotation shaft 62 via a one-way clutch 63 that transmits the counterclockwise rotation of the rotation shaft 62 to the second separating rollers 55-1, 55-2.

A first gear 64 is fixedly mounted on the tip of the rotation shaft 60 and a second gear 65 is mounted on the tip of the rotation shaft 62. A gear 66 of the pulse motor 52 meshes with the first gear 64, with an idle gear 67 provided between the first gear 64 and the second gear 65.

Additionally, the surfaces of first separating roller 50 and the second separating rollers 55-1, 55-2 are such that a coefficient of friction $\mu 2$ between the first separating roller 50 and the document sheet 21 and a coefficient of friction $\mu 3$ between the second separating rollers 55-1, 55-2 and the document sheet 21 are greater than a coefficient of friction $\mu 1$ between two document sheets 21.

A description will now be given of an operation of the sheet separator 33 having the structure described above.

When the pulse motor 52 is driven, the rotation shafts 60 and 62 are rotated in a counterclockwise direction, the first separating roller 50 and the second separating rollers 55-1, 55-2 are both rotated in the counterclockwise direction. The first separating roller 50 itself rotates and in turn rotates the first torque roller 51. The second separating rollers 55-1, 55-2 themselves rotate and in turn rotate the second torque rollers 56-1, 56-2, respectively. The number of teeth N1 of the first gear 64 and the number of teeth N2 of the second gear 65 are set appropriately. Accordingly, the peripheral velocity V2 of the second separating rollers 55-1, 55-2 is slightly slower than the peripheral velocity V1 of the first separating roller 50, such that V2=(0.9~0.95)=V1.

The pick-up roller 32 described previously normally picks up and sends onward only the uppermost document sheet 21-1. The document sheet 21-1 is sandwiched between and driven by the first separating roller 50 and the first torque roller 51, is further sandwiched between and driven by the second separating rollers 55-1, 55-2 and second torque rollers 56-1, 56-2 and passes through the sheet separator 33 in the manner shown in FIGS. 6A, 6B and 6C.

However, in the event that two document sheets 21-1 and 21-2 are stuck together one atop the other and double-fed from the hopper 20, then the sheet separator 33 operates in the manner shown in FIGS. 7A, 7B, 7C, 7D and 7E.

First, the leading edges of the two double-fed document sheets 21-1 and 21-2 reach the first separating mechanism 41, enter between the first separating roller 50 and the first torque roller 51, the first torque roller 51 separates from the first separating roller 50, the top sheet 21-1 contacts the first separating roller 50 and the bottom sheet 21-2 contacts the first torque roller 51.

In such a state, the coefficient of friction u1 between the top sheet 21-1 and the bottom sheet 21-2 is smaller than the coefficient of friction $\mu 4$ between the bottom sheet 21-2 and the first torque roller 51.

As a result, the top sheet 21-1 slides over the bottom sheet 21-2 while the bottom sheet 21-2 is braked by the frictional force exerted by the first torque roller 51 to which a braking force has been imparted by the first torque limiter 53. The progress of the second sheet 21-2 in the X1 direction is thereby halted, in a state in which the second sheet 21-2 is stopped at the first torque roller 51. As a result, the top sheet 21-1 begins to separate from the bottom sheet 21-2 as shown in FIGS. 7A and 7B.

Figure 7C:
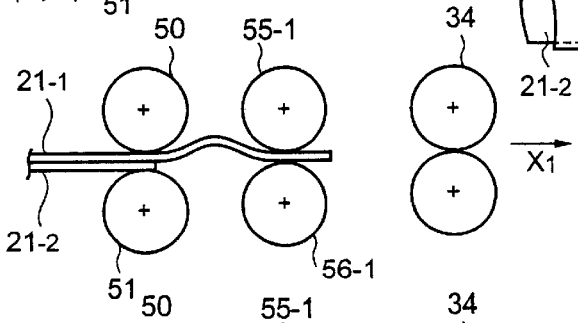
Figure 7D:
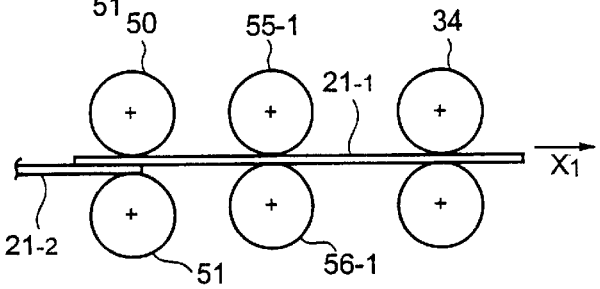
Figure 7E:
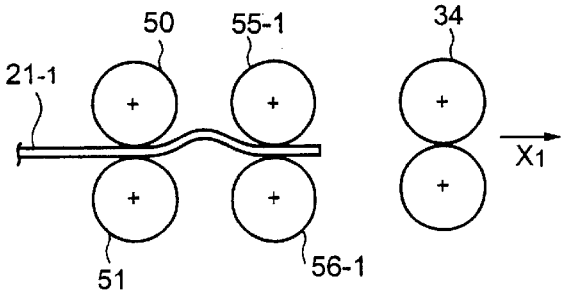

Further, once the top sheet 21-1 is fed onward as shown in FIGS. 7C and 7D the second sheet 21-2, which had been stopped at the first torque roller 51, is fed onward as shown in FIG. 7E.

In short, the first separating mechanism 41 of the sheet separator 33 acts to separate double-fed sheets.

Next, a description is given of a state in which two sheets 21-1 and 21-2 are stuck together so tightly that the two sheets 21-1 and 21-2 are not separated by the first separating mechanism 41 but pass through the first separating mechanism 41 unseparated, with reference to FIGS. 8A, 8B, 8C, 8D, 8E and 8F.

Figure 8A:
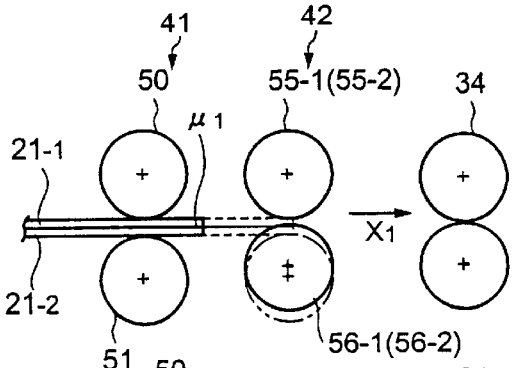
FIGS. 8A, 8B, 8C, 8D, 8E and 8F are diagrams showing the operation of the sheet separator when documents are double-fed without being separated by the first separating mechanism.

FIG. 8A shows a state in which two sheets 21-1 and 21-2 are double-fed to the first separating mechanism 41, are not separated by the first separating mechanism 41 and therefore pass through the first separating mechanism 41 unseparated, in which case the unseparated sheets 21-1 and 21-2 head toward the second separating mechanism 42.

When the two double-fed sheets 21-1 and 21-2, which are stuck together one atop the other, arrive at the second separating mechanism 42, the lead edges of the double-fed sheets 21-1 and 21-2 enter between the second separating rollers 55-1, 55-2 and the second torque rollers 56-1, 56-2, the second torque rollers 56-1, 56-2 separate from the second separating rollers 55-1, 55-2, the top sheet 21-1 contacts the second separating rollers 55-1, 55-2 and the bottom sheet 21-2 contacts the second torque rollers 56-1, 56-2 as indicated by the dotted chain lines in FIG. 8A.

Figure 8B:
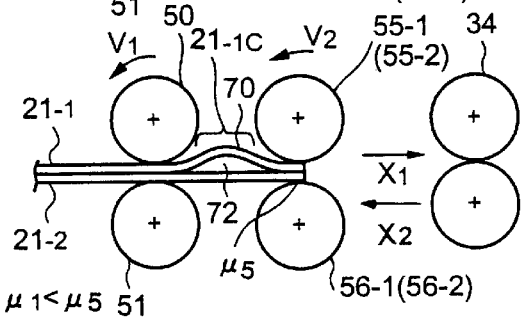
Figure 8C:
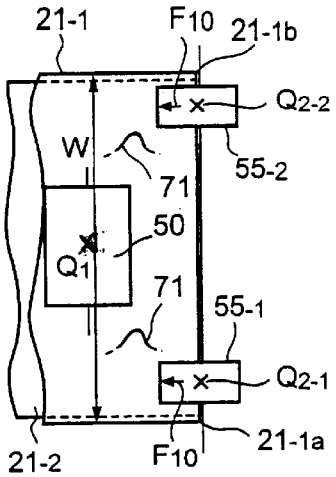

Directly thereafter, the chief operation of the present invention is performed, that is, the top sheet 21-1 is pinched so as to form an upward bulge and is separated from the bottom sheet 21-2 as shown in FIGS. 8B and 8C.

In the state shown in FIGS. 8B and 8C described above, the coefficient of friction u1 between the top sheet 21-1 and the bottom sheet 21-2 is less than the coefficient of friction $\mu$5 between the bottom sheet 21-2 and the second torque rollers 56-1, 56-2.

As a result, the top sheet 21-1 slides over the bottom sheet 21-2 while the bottom sheet 21-2 is braked by the frictional force exerted by the second torque rollers 56-1, 56-2 to which a braking force has been imparted by the second torque limiter 53. The progress of the second sheet 21-2 in the X1 direction is thereby halted, in a state in which the second sheet 21-2 is stopped at the second torque rollers 56-1, 56-2.

Additionally, the peripheral velocity V2 of the second separating rollers 55-1, 55-2 is slightly slower than the peripheral velocity Vi of the first separating roller 50. Moreover, as shown in FIG. 8C, the second separating rollers 55-1, 55-2 press against positions Q2-1, Q2-2 near corners 21-1*a*, 21-1*b* along both lateral edges of the top sheet 21-1. The first separating roller 50 and the first torque roller 51 are pressing against the top sheet 21-1 at a position Q1 which is both offset in the X2 direction from positions Q2-1 and Q2-2 and is at a central position in the lateral direction of the top sheet 21-1. It should be noted that the three positions Q1, Q2-1 and Q2-2 form an isosceles triangle with position Q1 as the apex thereof.

Accordingly, when viewed from position Q1 a force F10 appears to be exerted on positions Q2-1, Q2-2 of the top sheet 21-1 in the X2 direction while position Q1 appears to be fixed. It should be noted that the size of the force F10 corresponds to the difference between peripheral velocities V1 and V2 described above.

The force F10 exerted on positions Q2-1, Q2-2 causes a compressive force to act upon a portion 21-1*c* of the top sheet 21-1 that lies between position Q1 on the one hand and positions Q2-1 and Q2-2 on the other in the X1-X2 direction. An upwardly projecting bulge portion is formed in portion 21-1*c* as indicated by reference numeral 70 in FIG. 8B, which upwardly projecting bulge portion 70 is indicated by the bulge mark 71 in FIG. 8C.

As will be appreciated by those skilled in the art, the force F10 exerted at positions Q2-1 and Q2-2 exerts a twisting force with respect to position Q1. Moreover, as noted previously, positions Q2-1, Q2-2 are located near corner portions 21-1*a* and 21-1*b* of the top sheet 21-1, at which locations the top sheet is more easily separated from the bottom sheet. Accordingly, force F10 makes it easier to bend the central portion 21-1*c* upward into the bulge 70 described above.

Once the portion 21-1*c* of the top sheet 21-1 is bent upward into the bulge 70 described above, the top sheet 21-1 separates from the bottom sheet 21-1 to form a gap, then air is drawn into the gap to further separate the portions 21-1*c* from the bottom sheet 21-2, making the gap wide and thus weakening the force that causes the two sheets 21-1, 21-2 to stick together.

Figure 8D:
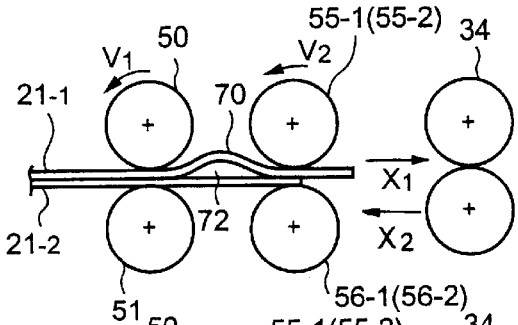
Figure 8E:
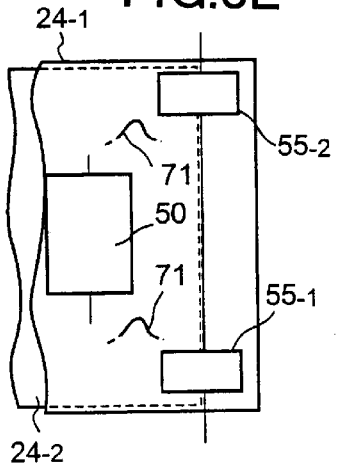

Next, as shown in FIGS. 8D and 8E, the top sheet 21-1 slides over the top of the bottom sheet 21-1 in the X1 direction. A force that compresses the central portion 21-1*c* of the top sheet 21-1 between positions Q1 on the one hand and positions Q2-1, Q2-2 on the other continues to be exerted during the time in which the top sheet 21-1 is sliding over the bottom sheet 21-2 in the X1 direction, and consequently an upwardly bulging portion continues to be formed in portion 21-1*c* as shown in FIG. 8D, the force causing the two double-fed sheets 21-1 and 21-2 to stick together continues to weaken and the top sheet 21-1 continues to slide easily over and securely separate from the bottom sheet 21-2.

Figure 8F:
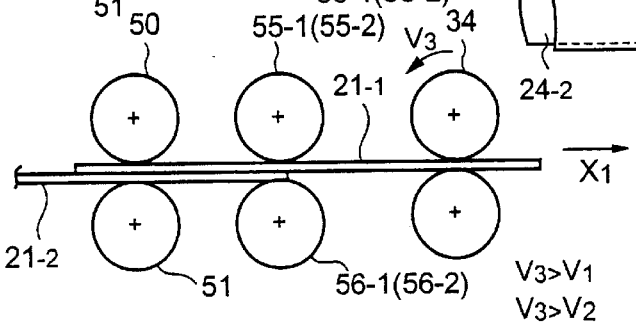

Once the leading edge of the top sheet 21-1 reaches the feed roller 34, the top sheet 21-1 is fed onward in the X1 direction by the feed roller 34 as shown in FIG. 8F. It should be noted that the peripheral velocity V3 of the feed roller 34 is faster than the peripheral velocity V1 of the first separating roller 50 as well as the peripheral velocity V2 of the second separating rollers 55-1, 55-2. Accordingly, the top sheet 21-1 is pulled by the feed roller 34, the first separating roller 50 as well as the second separating rollers 55-1, 55-2 are dragged by the top sheet 21-1 and are rotated faster than shafts 60, 62 while the one-way clutches 61, 63 spin freely, thus eliminating the abovedescribed upwardly projecting bulge portion 70.

Once the top sheet 21-1 is separated and fed onward, the bottom sheet 21-2, which had been stopped at the second torque rollers 56-1, 56-2 is fed onward as shown in FIG. 7E.

Figure 4:
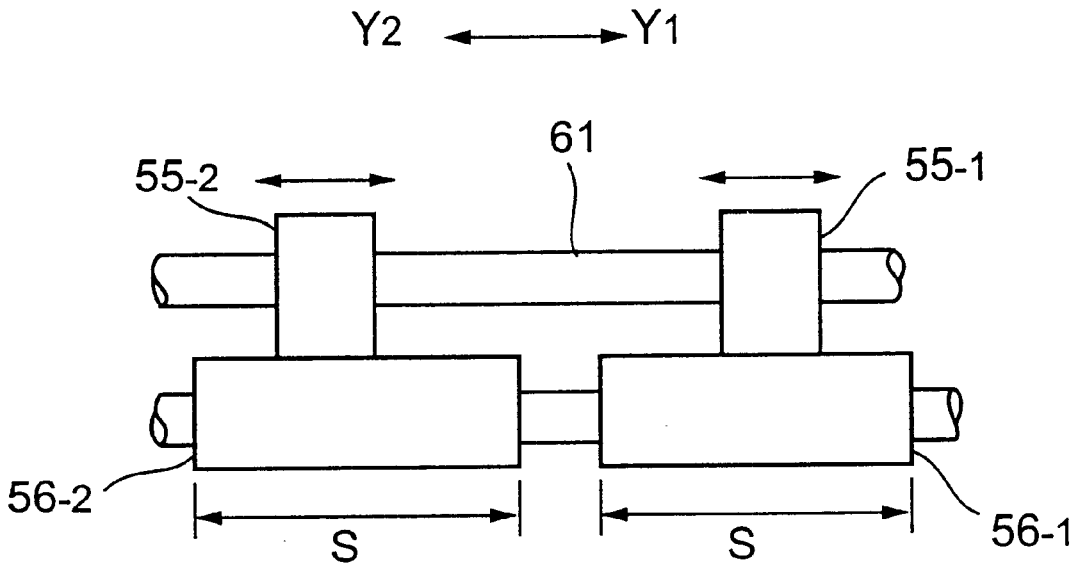
FIG. 4 is a view of the second separating mechanism as seen from the feed roller side.
Figures 5A, 5B:
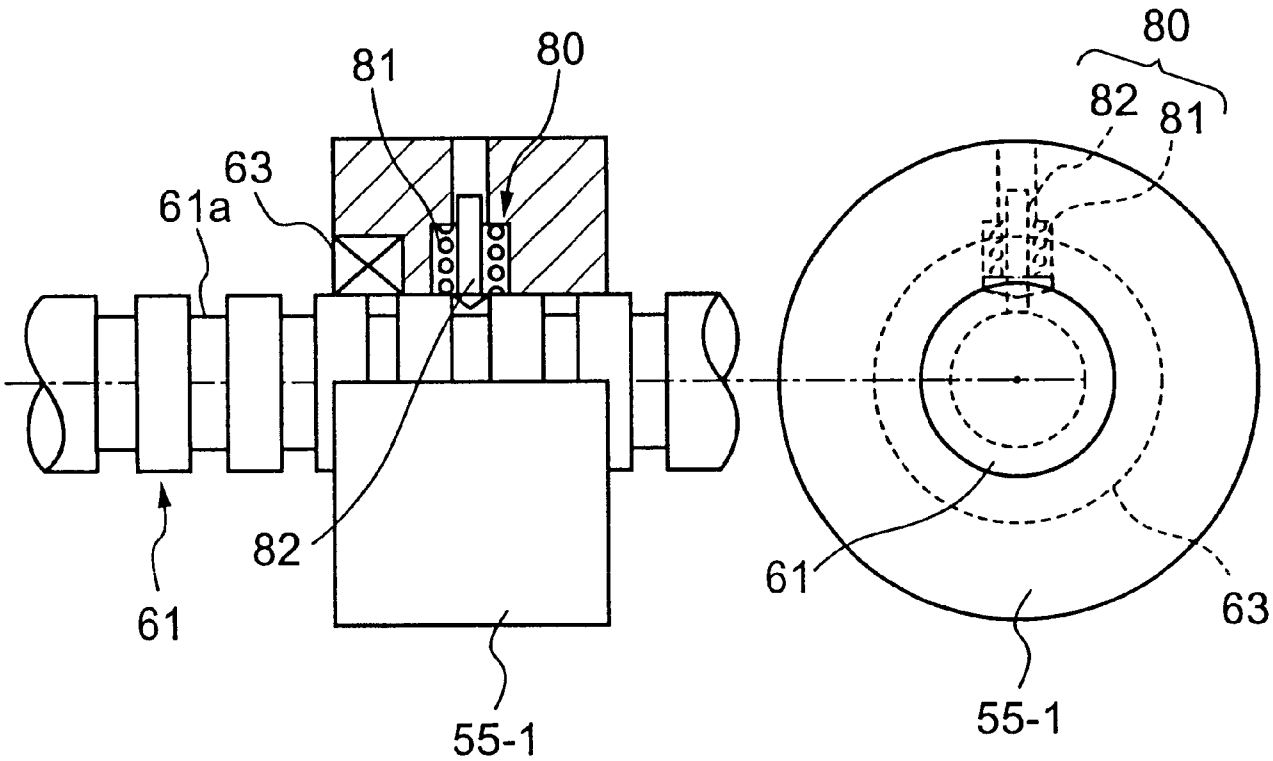
FIGS. 5A and 5B show the relation between the second separating rollers and the rotary shaft.

Next, a description will be given of the second separating rollers 55-1, 55-2 and the second torque rollers 56-1, 56-2, with reference to FIGS. 4 and FIGS. 5A and 5B.

As an initial matter, it should be noted that the second torque rollers 56-1, 56-2 have a comparatively long dimension S so as to cover the variety of document sizes to be handled by the sheet separator 33.

Additionally, a click-lock mechanism 80 comprising a coil spring 81 and a pin 82 is provided on the second separating roller 55-1, and annular grooves 61*a* are formed at regular intervals on the rotating shaft 61. Accordingly, the second separating roller 55-1 can be moved in the Y1–Y2 direction and fixed at a desired position.

Additionally, it should be noted that the other second separating roller 55-2 has a structure similar to that of the second separating roller 55-1 described above.

Accordingly, by changing the positions of the second separating rollers 55-1, 55-2 it is possible to accommodate a variety of different document sizes.

It should be noted that, alternatively, a link mechanism operated by a lever or the like may be provided in place of the above-described mechanism so as to move the two second separating rollers 55-1, 55-2 symmetrically with respect to the centerline CL described previously. Or, alternatively, a mechanism may be provided in which the two second separating rollers 55-1, 55-2 may be moved by a motor.

In addition, it should be noted that the present invention is not limited to the separation of documents or document sheets but may be used to separate ordinary sheets of paper as well.

The above description is provided in order to enable any person skilled in the art to make and use the invention and sets forth the best mode contemplated by the inventors of carrying out the invention.

The present invention is not limited to the specifically disclosed embodiment, and variations and modifications may be made without departing from the scope of the present invention.

The present application is based on Japanese Priority Application No. 11-230560, filed on Aug. 17, 1999, the entire contents of which are hereby incorporated by reference.

What is claimed is:

1. A sheet separator that separates sheets of documents supplied as a stack into single sheets, the sheet separator comprising:

a first separating mechanism having a first separating roller and a first torque limited roller; and a second separating mechanism having a second separating roller and a second torque limited roller, the second separating mechanism provided at a position downstream from a position of the first separating mechanism.

2. The sheet separator as claimed in claim 1, wherein a peripheral velocity of the second separating rollers is set lower than a peripheral velocity of the first separating roller.

3. The sheet separator as claimed in claim 1, wherein the first separating roller is positioned so as to act upon a central portion in a lateral direction of a sheet transported thereto, and the second separating roller is positioned so as to act upon edge surface portions in the lateral direction of the sheet transported thereto.

4. The sheet separator as claimed in claim 1, wherein a peripheral velocity of the second separating roller is set lower than a peripheral velocity of the first separating roller;

the first separating roller is positioned so as to act upon a central portion in a lateral direction of a sheet transported thereto; and the second separating rollers are positioned so as to act upon edge surface portions in the lateral direction of the sheet transported thereto.

5. The sheet separator as claimed in claim 1, wherein the second separating rollers are supported so that positions of the second separating rollers in a lateral direction of a sheet transported thereto can be changed.

6. The sheet separator as claimed in claim 1, wherein a distance between the first separating mechanism and the second separating mechanism is shorter than a longitudinal length of the sheet.

7. An optical document reader comprising:

a hopper, to which a plurality of sheets can be set;

a sheet separator that separates sheets of documents supplied as a stack into single sheets;

a feed roller that transports documents;

an optical document reading unit that optically reads data inscribed on the documents; and a stacker that stacks and outputs documents from which data has been optically read by the optical reading unit, the sheet separator comprising:

a first torque limited separating mechanism having a first torque limited separating roller; and a second separating mechanism having second separating rollers, the second separating mechanism provided at a position downstream from a position of the first separating mechanism.

* * * * *